United States Patent [19]

Yagi et al.

[11] Patent Number: 4,747,293

[45] **Date of Patent: * May 31, 1988**

[54] BENDING APPARATUS

[75] Inventors: Sigenori Yagi; Junosuke Yagi, both of Hyogo, Japan

[73] Assignee: Sinsei Mfg. Co., Ltd., Hyogo, Japan

[ * ] Notice: The portion of the term of this patent subsequent to May 19, 2004 has been disclaimed.

[21] Appl. No.: 943,060

[22] Filed: Dec. 18, 1986

[30] Foreign Application Priority Data

Apr. 22, 1986 [JP] Japan ..... 61-93000

[51] Int. Cl.[4] ..... B21D 7/024

[52] U.S. Cl. ..... 72/307; 72/294

[58] Field of Search ..... 72/307, 294, 306, 316, 72/319, 322, 388, 384, 217–219

[56] References Cited

U.S. PATENT DOCUMENTS 3,373,587 3/1968 Shubin et al. ..... 72/307

3,493,016 2/1970 Ott ..... 72/307

4,665,731 5/1987 Yagi et al. ..... 72/307

*Primary Examiner*—Daniel C. Crane

*Attorney, Agent, or Firm*—James E. Nilles; Donald C. McGaughey

[57] ABSTRACT

A bending apparatus wherein a blank is passed through a guide hole of a blank guide, the tip of the blank is passed through a blank insertion portion of a bending operation member and is fed in a predetermined length, the bending direction of the bending operation member is determined by the rotation of a bending direction determination member to a desired angular position, the bending operation member is rotated by a predetermined angle by the sliding operation of a bending drum thereby to bend and shape the blank, and thereafter a cutting blade is moved by the sliding operation of a cutting drum to cut the blank that has thus been bent and shaped.

5 Claims, 5 Drawing Sheets

BENDING APPARATUS

BACKGROUND OF THE INVENTION

1. Field of the Invention

This invention relates to a bending apparatus for bending elongated blanks such as wire materials, rod materials, tubular materials, and the like.

2. Description of the Prior Art

Wire form works obtained by bending wire materials such as iron wires, hard steel wires, and the like, have gained a wide application as cushion frames for the seat of cars, electric home appliances such as an oven toaster, and so forth. To produce these components, single-purpose machines typified by benders and air slides using a power press, a hydraulic press, a multi-press or an air cylinder have been widely employed in the past.

However, each of these machines requires a metal mold or a special jig analogous to the mold and a considerable number of production steps are necessary and the production cost is therefore high.

In addition, the bending direction of these machines is determined in advance and blanks cannot be bent in an arbitrary direction.

SUMMARY OF THE INVENTION

The present invention contemplates to eliminate these problems with the prior art. It is therefore an object of the present invention to provide a bending apparatus which does not need any metal mold or a special jig analogous to the mold but can easily and freely bend blanks at a desired angle in a desired direction.

A bending apparatus in accordance with the present invention comprises a cylindrical blank guide equipped at its center with a guide hole for passing an elongated blank therethrough in an axial direction; a bending direction determination member disposed around the outer peripheral portion of the blank guide and set to an arbitrary rotating position; a bending operation member disposed at a front portion of the bending direction determination member in such a manner as to be capable of rotating around a support shaft extending in a direction at right angles to the guide hole, and having a blank insertion portion facing the tip of the blank guide; a cutting blade disposed slidably on the front surface of the bending operation member; a bending drum disposed slidably in the axial direction around the outer peripheral portion of the bending direction determination member and rotating the bending operation member when connected to the bending operation member and slid; and a cutting drum disposed slidably in the axial direction around the outer peripheral portion of the bending direction determination member and moving the cutting blade when connected to the cutting blade and slid.

In the bending apparatus of the present invention, the blank is passed through the guide hole of the blank guide, the tip of the blank is passed through the blank insertion portion of the bending operation member and is fed in a predetermined length, the bending direction of the bending operation member is determined by the rotation of the bending direction determination member to a desired angular position within 360°, the bending operating member is rotated by a predetermined angle by the sliding operation of the bending drum 57 thereby to bend and shape the blank, and thereafter the cutting blade is moved by the sliding operation of the cutting drum to cut the blank that has thus been bent and shaped.

The above and other objects and novel features of the present invention will become more apparent from the following description when taken in conjunction with the accompanying drawings.

DESCRIPTION OF THE PREFERRED EMBODIMENTS

Figure 1:
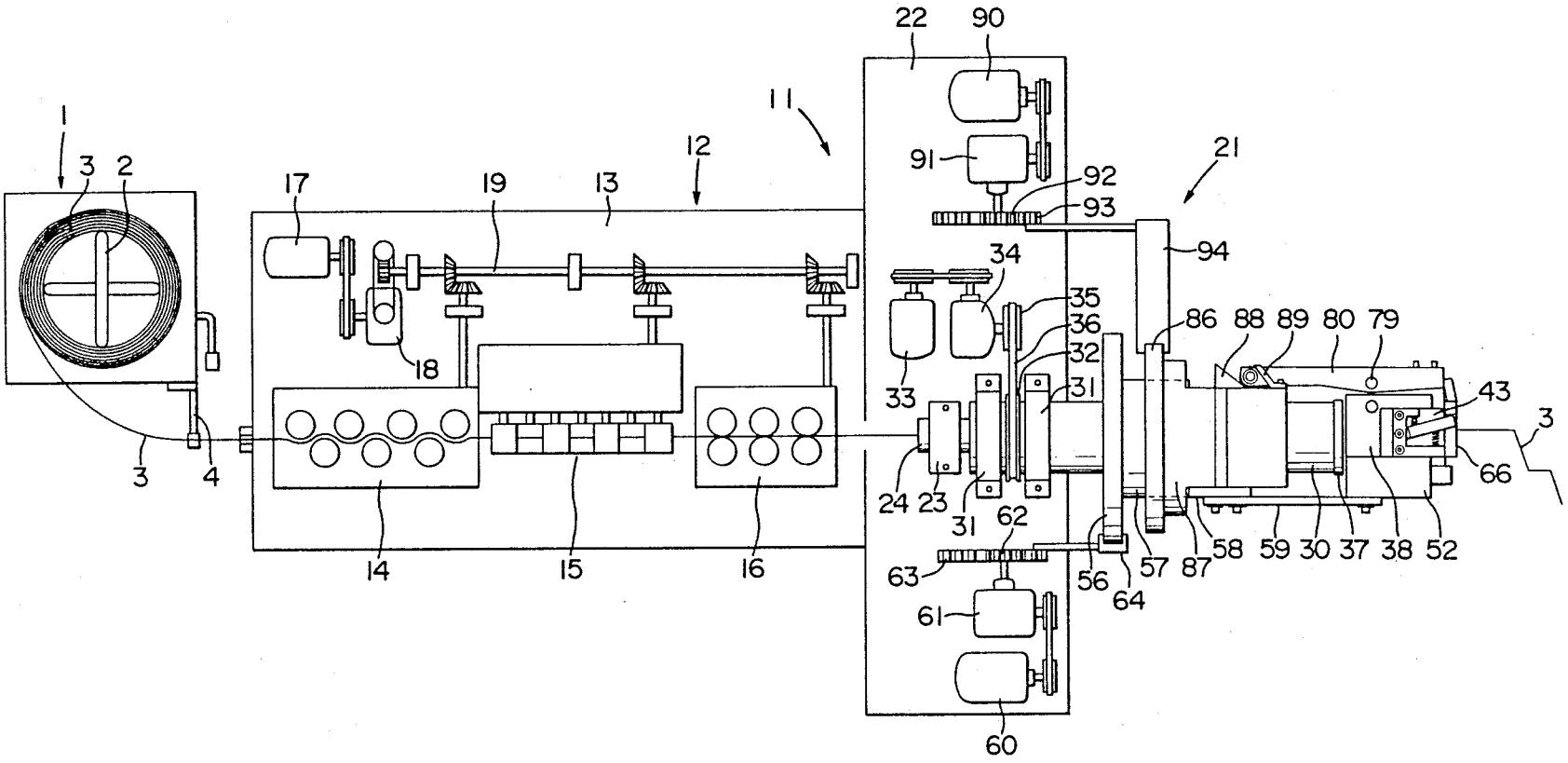
FIG. 1 is a plan view showing a bending apparatus in accordance with one embodiment of the present invention.

In FIG. 1, reference numeral 1 represents a reel stand, and an elongated blank (e.g. wire) 3 such as an iron wire or a hard steel wire is wound on a reel 2 which is rotated by a variable speed motor, not shown, inside the reel stand 1. An arm 4 projects from the reel stand 1 in order to synchronize the feed speed of the blank 3 on the reel stand 1 with a bending speed in a later-appearing forming machine main body 11.

A feeder 12 is disposed inside the forming machine main body 11 in the proximity of the reel stand 1. Correction rollers 14, 15 for making the blank 3 straight and a chucking roller 16 for feeding the blank 3 while preventing the rotation of the blank 3 are disposed sequentially on a base 13 inside the feeder 12. The rollers 14, 15, 16 are driven by a servo motor 17 disposed on the base 13 through a reduction gear 18 and a transmission mechanism 19 such as bevel gears.

After the blank 3 is pulled out from the reel 2 of the reel stand 1 and passed through the rollers 14, 15, 16 through the arm 4, the rollers 14, 15, 16 are driven for rotation by the motor 17 through the reduction gear 18 and the transmission mechanism 19. The blank 3 is made straight by the rollers 14, 15 and fed in a predetermined length while being prevented from rotating by the roller 16.

Figure 2:
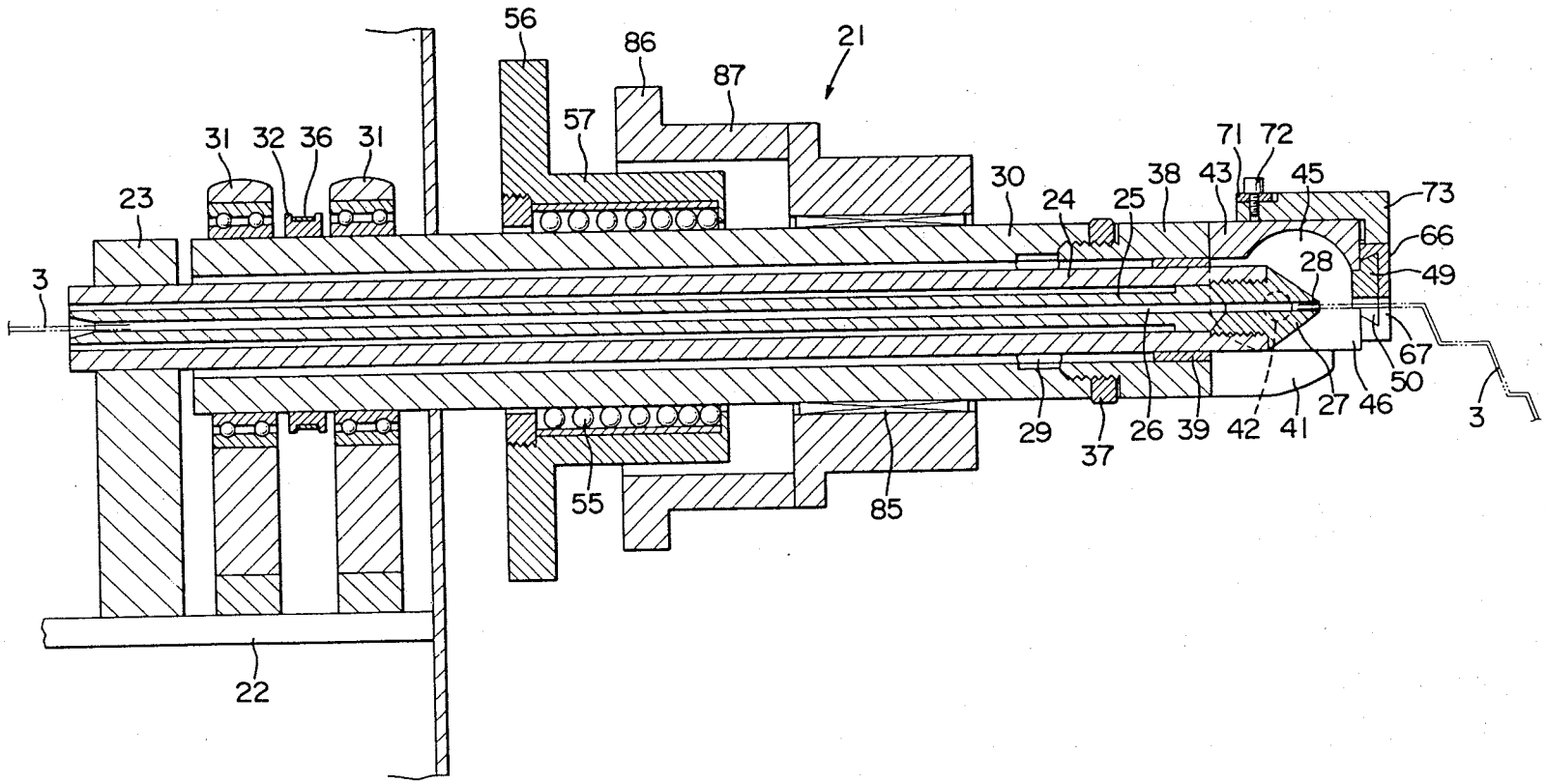
FIG. 2 is a sectional view of the principal portions of FIG. 1.

A bending machine 21 is disposed in succession to the feeder 12 inside the forming machine main body 11. Inside this bending machine 21, a cylindrical blank guide 24 whose rear end portioon is supported by a support bed 23 is disposed transversely on a base 22 as shown in FIG. 2. The cylindrical blank guide 24 includes a cylinder 25 and a substantially concial work or bending head 27. The guide cylinder 25 is fitted in the center of the blank guide 24 to extend therethrough in an axial direction. A guide hole 26, defining a bore axis, is bored at the center of this guide cylinder 25 in its axial direction in order to pass the blank 3 therethrough. Further, the work or bending head 27, which can be replaced in accordance with the diameter of the blank 3, is screw threaded into the tip of the blank guide 24, and a guide hole or bore opening 28 is bored at the center of this work head 27 in such a manner as to continue the guide hole 26 as described above.

A bending direction determination member 30 is fitted concentrically and rotatably to the outer peripheral portion of the blank guide 24 through a needle bearing 29 disposed at a front portion, and the rear end portion of this bending direction determination member 30 is rotatably supported by two bearings 31 on the base 22. A pulley 32 is disposed at the rear end portion of the bending direction determination member. Furthermore, an endless timing belt 36 is extended between a pulley 35 of a reduction gear 34 driven by a stepping motor 33 for controlling the bending direction and the pulley 32 of the bending direction determination member 30 as shown in FIG. 1.

The blank 3 is passed through the guide hole 26 of the guide cylinder 25 of the blank guide 24 and then through the guide hole 28 of the work head 27, and the bending direction determination member 30 can be rotated at an arbitrary angle within 360° with the blank guide 24 being the center, by the driving force of the motor 33 through the reduction gear 34, the pulley 35, the endless timing belt 36 and the pulley 32.

Figure 3:
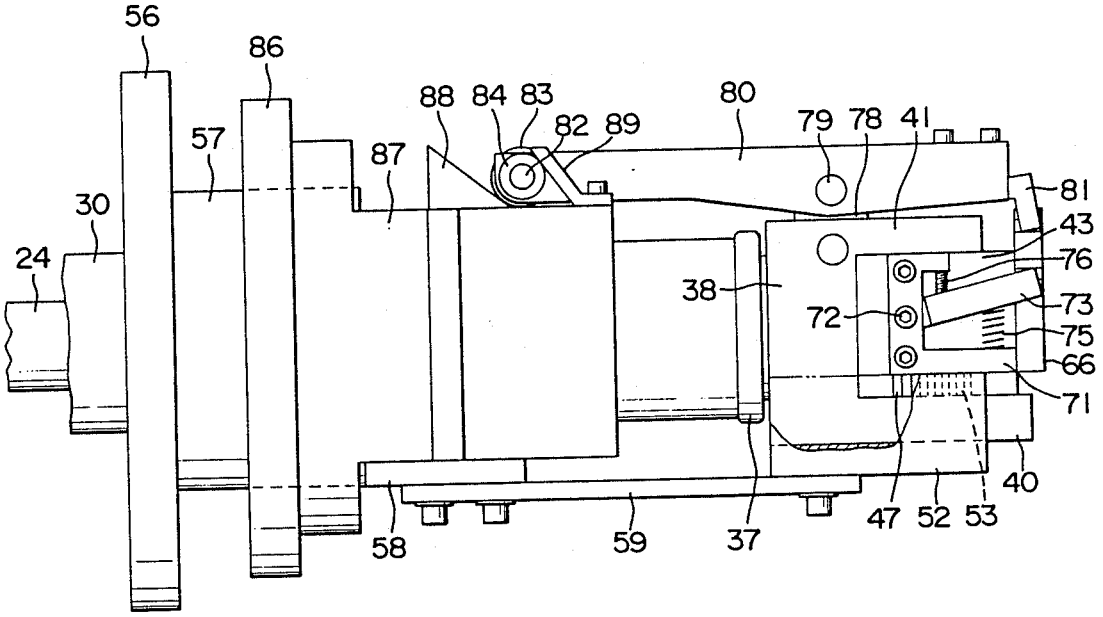
FIG. 3 is a plan view of FIG. 2.
Figure 6:
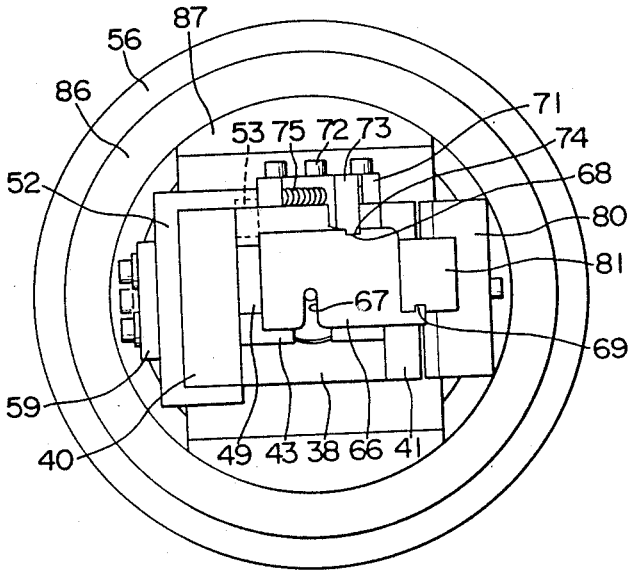
FIG. 6 is a front view of FIG. 2.
Figure 7:
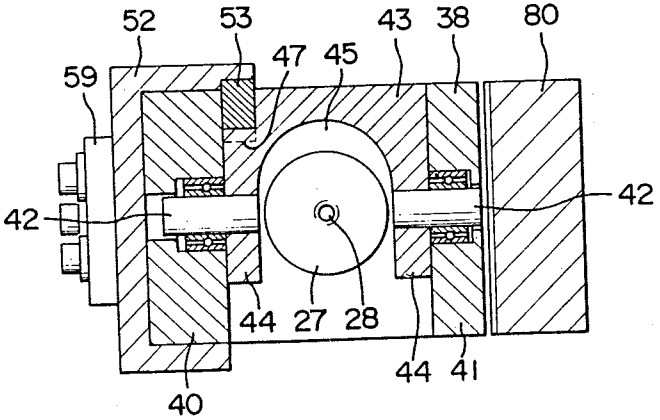
FIG. 7 is a sectional view of a bending operation unit.

As shown in FIG. 2, the base portion of a shaft support 38 is fixed by a fixing nut 37 to the tip of the bending direction determination member, and supports the front portion of the blank guide 24 through a bearing 39 inside the shaft support 38. The shaft support 38 has shaft support portions 40, 41 that are disposed in parallel with each other on both sides of the tip of the shaft support 38 in a substantially ]-shaped form as viewed from the top as shown in FIGS. 3, 6 and 7. One (40) of these shaft support portions is longer forwardly and thicker than the other (41).

Figure 8:
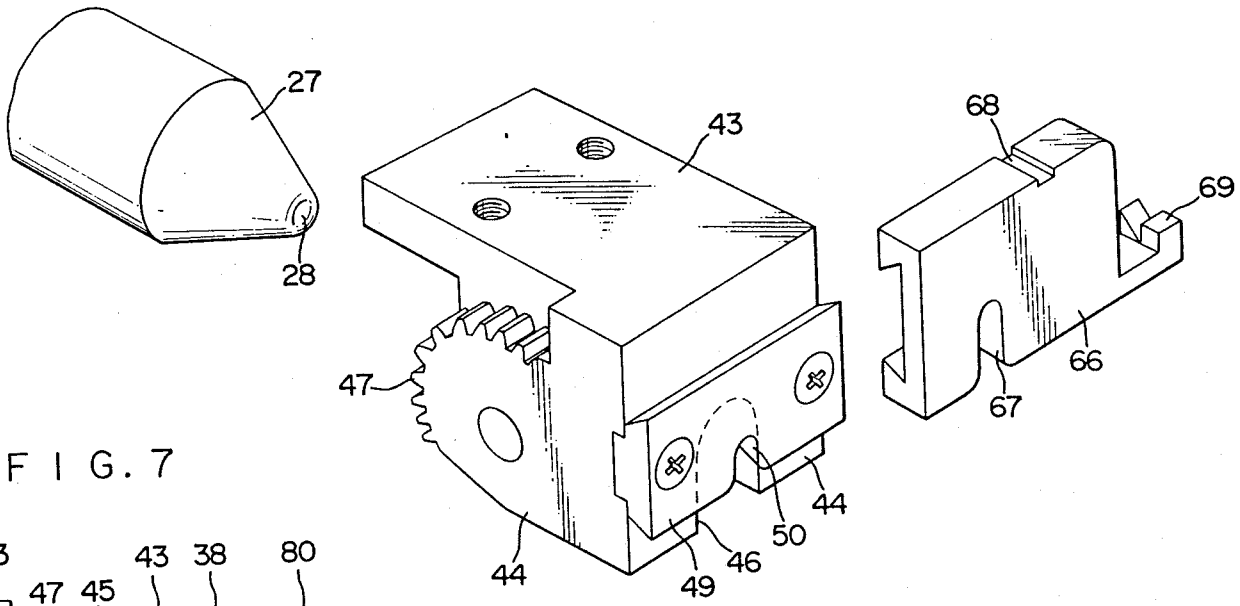
FIG. 8 is an exploded perspective view of FIG. 7.

A U-shaped bending operation 43, for the work head 27 at the tip of the blank guide 24, has a pair of legs or plate portions 44 joined by a laterally extending bight portion (FIG. 7) and is rotatably supported by both side plate portions 44 in cooperation with support shafts 42 that are disposed on both sides of the bending operation member 43 and in a direction at right angles to the guide hole 26. The shafts 42 constitute means defining a bending axis that is near the bore axis of the guide hole 26 and, as shown in FIG. 2, rearwardly adjacent to the front end of work head 27. The bending axis 42 is transverse to the axis of bores 26, 28. A hollow or elongated slot 45 for the work head 27 is formed inside the bending operation member 43, and a substantially U-shaped blank insertion portion 46 is also formed on the bending operation member 43 in such a manner as to extend from the lower end of the operation member 43 to its center where the operation member faces the tip of the guide hole 28 of the work head 27 as shown in FIG. 8. As shown in FIGS. 1, 3 and 8, each of the leg or plate portions 44 has a flat front surface with both surfaces being coplanar and forward of the front end of the cylindrical blank guide 24.

A pinion 47 is formed integrally at the rear portion of one (44) of the side plates of the bending operation member 43 with the support shaft 42 being the center, as shown in FIG. 8. The pinion 47 constitutes means on the U-shaped member 44 cooperating with the bending axis 42 to confine the U-shaped member to pivotal movement about the bending axis 42 relative to the bending direction determination member 30. Further, a bending operation plate 49 is fixed to the front end surface of the bending operation member 43 and a substantially U-shaped bending operation portion or elongated slot 50 is formed on this bending operation plate 49 in such a manner as to extend from its center portion to the lower end. The elongated slot 50 is between the legs 44, is of a width to closely receive the material to be bent and has an inner end which is adjacent to the bight portion extending between the legs 44. The plate slot 50 provides a fixed shearing edge or blade as will be described hereinafter. The inner end of slot 50 applies bending force to the material.

As shown in FIGS. 3, 6 and 7, a slider 52 having a substantially ]-shaped section is supported slidably back and forth on one side portion of the shaft support 38, and a rack 53 meshing with the pinion 47 of the bending operation member 43 is fixed to the upper part of the inner surface of the slider 52.

Figure 4:
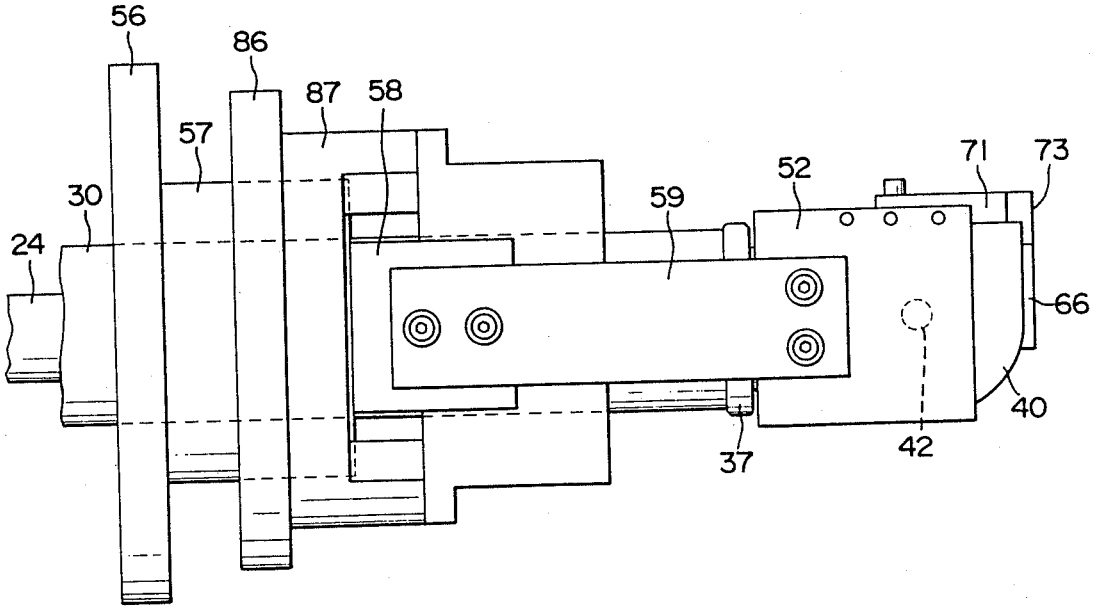
FIG. 4 is a left side view of FIG. 2.

A bending drum 57 having integrally a flange 56 is fitted slidably in the axial direction to the outer peripheral portion of the bending direction determination member 30 as shown in FIG. 2, and this bending drum 57 and the slider 52 described above are connected to each other through an adjustment plate 58 and a connection plate 59 as shown in FIGS. 3 and 4.

A stepping motor 60 for controlling the bending angle and a reduction gear 61 driven by this stepping motor 60 are disposed on the base 22 as shown in FIG. 1 and a pinion 62 is fitted to the output shaft of the reduction gear 61. A rack 63 meshes with this pinion 62, and a recessed connecting member 64 meshing with the flange 56 of the bending drum 57 in the circumferential direction is disposed on the rack 63.

When the motor 60 is actuated, the bending drum 57 is slid in the axial direction through the reduction gear 61, the pinion 62, the rack 63, the connecting member 64 and the flange 56 engaging with the connecting member 64, and the slider 52 is moved back and forth through the adjustment plate 58 and the connecting plate 59 so that the bending operation member 43 having the bending operation plate 49 is rotated by a desired angle with the support shaft 42 being the support point.

Next, the cutting mechanism will be described. As shown in FIGS. 6 and 8, a cutting blade 66 is disposed slidably in the transverse direction on the front surface of the bending operation plate 49 serving also as a fixed blade through dovetail groove engagement of the upper and lower side portions, and a substantially U-shaped blank insertion portion 67 is formed at a position close to one side of this cutting blade 66 in such a manner as to extend from the lower end. An engagement recess 68 is formed at the upper side portion of the cutting blade 66 and a substantially L-shaped engagement projection 69 is formed on the opposite side of the cutting plate 66.

A support frame 71 having a ]-shape when viewed from the top is fixed to the upper surface of the bending operation member 43 as shown in FIGS. 3 and 6, and the base portion of an arm 73 is supported to this support frame 71 by a support shaft 72 in such a manner as to be capable of rotating horizontally. An engagement portion 74 engaging with the engagement recess 68 of the cutting blade 66 is formed at the tip of this arm 73 and a coil spring 75 is interposed between one side portion of the support frame 71 and the arm 73. A stopper 76 projects from the other side portion of the support frame 71. The arm 73 is always urged towards the stopper 76 by the spring 75, and the cutting blade 66 is always held at the position where its blank insertion portion 67 coincides with the bending operation portion 50 of the bending operation plate 49, through the engagement between the engagement portion 74 and the engagement recess 68.

Figure 5:
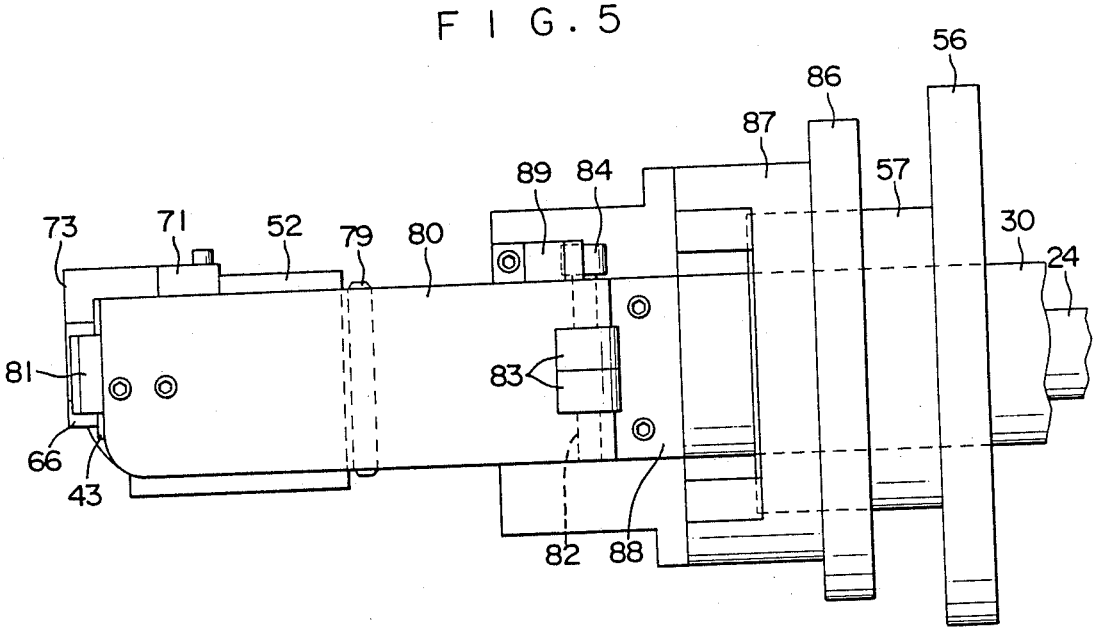
FIG. 5 is a right side view of FIG. 2.

The intermediate portion of a cutting blade operation lever 80 is supported rotatably in the horizontal direction by a support shaft 79 on a support bed 78 on the other side portion of the shaft support 38 as shown in FIGS. 3 and 5, and an engagement member 81 engaging with the engagement projection 69 of the cutting blade 66 is disposed at the tip of this lever 80. A cutting roller 83 and a return roller 84 are supported rotatably in a shaft 82 at the rear end portion of the lever 80.

A cutting drum 87 having integrally a flange 86 is fitted sliably in the axial direction to the outer peripheral portion of the bending direction determination member 30 through the slide bearing 85 as shown in FIG. 2, and a substantially triangular cutting cam 88 corresponding to the cutting roller 83 and a return push plate 89 corresponding to the return roller 84 are fitted to the side surface of the cutting drum 87.

Furthermore, a motor 90 for cutting and a reduction gear 91 driven by this motor 90 are disposed on the base 22 as shown in FIG. 1 and a pinion 92 is fitted to the output shaft of the reduction gear 91. A rack 93 meshes with this pinion 92 and a recessed engagement member 94 engaging with the flange 86 of the cutting drum 87 slidably in the circumferential direction is disposed on this rack 93.

When the motor 90 is actuated, the cutting drum 87 is slid in the axial direction through the reduction gear 91, the pinion 92, the rack 93, the engagement member 94 and the flange 86, and the lever 80 rotates through the cutting cam 88 and the cutting roller 83 with the support shaft 79 being the support point, while the cutting blade 66 is moved transversely through the engagement projection 69, thereby cutting the blank 3 between the bending operation plate 49.

When the cutting blade 66 moves to the left in FIG. 6 during the cutting operation of the blank 3, its end surface strikes the thick shaft support portion 40 whose end surface projects on one side of the shaft support 38 and is stopped. Thus, the shock, particularly at the time of cutting a thick blank 3, is absorbed.

Next, when the motor 90 rotates reversely and the cutting drum 87 moves rearward, the return operation plate 89 pushes the return roller 84 so that the lever 80 is rotated reversely and the cutting blade 66 returns.

Incidentally, when the bending operation member 43 rotates and makes the bending operation, the engagement member 81 of the lever 80 disengages from the engagement projection 69 of the cutting blade 66, but the cutting blade 66 keeps its position because it is supported by the arm 73 that is urged by the spring 75.

Next, the overall operation will be described.

The blank 3 is pulled out from the reel stand 1 and passed through the rollers 14, 15, 16 and then through the guide hole 26 inside the blank guide 24 and the guide hole 28 of the work head 27 and its tip is extended to the blank insertion portion 46 of the bending operation member 43 and the blank insertion portion 67 of the cutting blade 66. Thereafter the blank 3 is fed by a predetermined length by the roller 16.

The motor 33 is driven to rotate the bending direction determination member 30 by a predetermined angle and at the same time, to rotate the bending operation member 43 by a predetermined angle. Thus, the bending direction of the blank 3 is determined.

Then, the motor 60 is actuated and the bending drum 57 is slid in the axial direction. The slider 52 is moved in the axial direction through the connecting plate 59, and the bending operation member 43 is rotated with the support shaft 42 being the support point through the rack 53 and the pinion 47. At this time, the bending operation portion 50 of the bending operation plate 49 pushes sideways the blank 3 and the blank 3 is bent with the tip of the work head 27 of the blank guide 24 being the reference. Therefore, the bending angle is determined by the moving quantity of the bending drum 57 based upon the rotating quantity of the motor 60.

In this manner the blank 3 is fed into the blank guide 24 in the predetermined length and the portion of the blank 3 projecting from the work head 27 of the blank guide 24 is bent in an arbitrary direction determined by the rotating angle of the bending direction determination member 30 within 360° by an arbitrary angle determined by the swivel angle of the bending operation member 43. The blank 3 is shaped sequentially in a predetermined shape by repetition of this operation, that is, the feed of the blank 3 in the predetermined length and setting of the rotating position of the bending direction determination member 30 and the rotating angle of the bending operation member 43 for each bending step. Finally, the motor 90 is operated to slide the cutting drum 87 in the axial direction and the cutting blade 66 through the lever 80, so that the blank that has been bent is cut between the cutting blade 66 and the bending operation plate 49, and the motor 90 is then rotated reversely so as to return the cutting blade 66 to its initial position.

In this case, an arbitrary bending work becomes possible by numerically controlling the driving and stop of the motors 17, 23 and 60 by use of a microcomputer. Bending of the blank 3 in a curved shape becomes possible by rotating the bending operation member 43 while the blank 3 is being fed.

As described above, the bending operation member 43 and the cutting blade 66 are rotated integrally with the bending direction determination member 30, and the bending drum 57 and the cutting drum 87 for actuating the bending operation member 43 and the cutting blade 66 are disposed around the outer peripheral portion of the bending direction determination member 30. Accordingly, the blank 3 can be bent easily and freely in a desired direction within 360° and by a desired angle, and can be cut at the position of the rotating angle.

Besides the wire materials described in the embodiment, the present invention can be used for other blanks such as rod materials and tubular materials or odd-shaped blanks of these rod and tubular materials.

In accordance with the present invention, the bending operation member and the cutting blade are rotated integrally with the bending direction determination member, and the bending drum and cutting drum for operating the bending operation member and the cutting blade are disposed around the outer peripheral portion of the bending direction determination member, so that the blank can be bent easily and freely in a desired direction within the range of 360° by a desired angle and can be cut at the position of the rotating angle.

What is claimed is:

1. An apparatus for bending elongated material such as wire, comprising a cylindrical blank guide (24, 25, 27) through which material to be bent is advanced lengthwise in a forward direction and which has a guide bore having an opening (26, 28) at a front end thereof that defines a bore axis and wherein the material has a close slidable fit to be confined laterally, a bending direction determination member (30) having a tip end portion and an outer peripheral portion, said bending direction determination member mounted in surrounding relation to said cylindrical blank guide (24, 25, 27) and having means thereon defining a bending axis (42) that is transverse to said bore axis, said bending direction determination member being adjustably rotatable about said bore axis for disposing said bending axis (42) in any desired orientation, and a bending operation member (43) movable in opposite directions about said bending axis (42) and engageable, when in operation with a portion of said material that projects forwardly beyond said front end of said cylindrical blank guide (24, 25, 27) for bending the same, said apparatus being characterized by:

A. said bending axis (42) being near said bore axis and rearwardly adjacent to said front end of said cylindrical blank guide (24, 25, 27);

B. said bending operation member (43) comprising (1) a substantially U-shaped member having (a) a pair of legs (44) connected by a laterally extending bight portion, (b) an elongated slot (45, 50) between said legs which is of a width to closely receive the material and which has an inner end adjacent to said bight portion that is adapted to apply bending force to the material, and (c) a flat front surface portion on each of said legs, said surface portion on one of said legs being coplanar with that on the other of said legs and extending to said slot to define a shearing edge thereat, and (2) means (47) on said U-shaped member cooperating with said means that defines the bending axis (42) to mount said U-shaped member on said bending direction determination member (30) to place said flat front surface portion adjacent and forward of said front end of said cylindrical blank guide (24, 25, 27) with its said legs (44) on opposite sides of said bore axis, and to confine the U-shaped member to pivotal movement about said bending axis relative said bending direction determination member (30) whereby said inner end of said slot is carried across the bore axis for applying bending force to material projecting forward from the bending head;

C. a cutting blade (66) mounted on said bending operation member (43) in sliding relation to said flat front surface portion for movement in opposite directions substantially parallel to said bending axis (42), said cutting blade (66) having a cutting edge extending substantially parallel to said legs, said sliding movement of said cutting blade carrying said cutting edge across said slot to cooperate with said shearing edge for cutting through material that projects forward from the bending head;

D. a bending drum (57) connected to said bending operation member (43) and slidably mounted on said outer peripheral portion of said bending direction determination body (30) for axial movement relative thereto to rotate said bending operation body (43) about said bending axis (42); and E. a cutting drum (87) connected to said cutting blade (66) and slidably mounted on said outer peripheral portion of said bending direction determination body (30) for axial movement relative thereto to move said cutting blade (66).

2. The bending apparatus according to claim 1, further comprising a cutting blade operation lever (80) having a tip end portion, a rear end portion, and a middle portion, said middle portion rotatably mounted on said bending direction determination body (30), said tip end portion operatively engaged with said cutting blade (66), a cutting roller (83) rotatably mounted on said rear end portion of said cutting blade operation lever (80), a cutting cam (88) mounted on said cutting drum (87) in operative engagement with said cutting roller whereby said lever is pivoted to slide said cutter (66) in response to said axial movement of said cutter drum, a return roller (84) rotatably mounted on said rear end portion of the cutting blade operation lever (80) in transversely spaced coaxial relation to said cutting roller (83), and a return push plate (89) mounted on said cutting drum (87) in operative engagement with said return roller (84).

3. The bending apparatus according to claim 1, further comprising a shaft support (38) having spaced apart front sides mounted on said tip end portion of said bending direction determination member (30), and a shaft supporting portion (40, 41) projecting from each of said front sides of said shaft support (38) for supporting rotatably therebetween said bending operation member (43), one of said shaft supporting portions (40) being made longer than the other (41) and acting as a stop for said cutting blade (66).

4. The bending apparatus according to claim 3, wherein one of said shaft supporting portions (40) is formed thicker than the other (41).

5. The bending apparatus according to claim 1, wherein said bending operation member (43) further comprising a bending operation plate (49) mounted on said flat front surface portion of said bending operation member (43) and presenting said shearing edge, said cutting blade (66) being slidably mounted in overlying relation to said operation plate (49).

* * * * *